US006683242B2

(12) United States Patent
Inoue et al.

(10) Patent No.: US 6,683,242 B2
(45) Date of Patent: Jan. 27, 2004

(54) COMPOSITE KEYBOARD MUSICAL INSTRUMENT, SILENT SYSTEM FOR PERFORMANCE WITHOUT ACOUSTIC TONES AND REGULATING BUTTON MECHANISM FOR CHANGING ESCAPE TIMING DEPENDING UPON MODE OF OPERATION

(75) Inventors: Satoshi Inoue, Shizuoka-ken (JP); Kiyoshi Kawamura, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 135 days.

(21) Appl. No.: 10/085,603

(22) Filed: Feb. 26, 2002

(65) Prior Publication Data

US 2002/0121183 A1 Sep. 5, 2002

(30) Foreign Application Priority Data

Mar. 1, 2001 (JP) ..... 2001-057117

(51) Int. Cl.[7] ..... G10A 1/32
(52) U.S. Cl. ..... 84/719
(58) Field of Search ..... 84/17–20, 236, 84/243–244, 247–250, 170, 171, 600, 621, 718–720, 743–745

(56) References Cited

U.S. PATENT DOCUMENTS 5,583,306 A * 12/1996 Hayashida et al. ..... 84/171
5,844,154 A * 12/1998 Kimble ..... 84/171
6,423,889 B2 * 7/2002 Inoue ..... 84/236

* cited by examiner

*Primary Examiner*—Jeffrey Donels
(74) *Attorney, Agent, or Firm*—Morrison & Foerster LLP

(57) ABSTRACT

A silent piano is a composite keyboard musical instrument fabricated on the basis of an acoustic piano, and a pianist plays a tune by piano tones or electronic tones; when the pianist selects the electronic tones, a hammer stopper enters the trajectories of hammers, and a tandem regulating button mechanism changes damping columns onto the trajectories of jacks in such a manner that the jack is brought into contact with the damping column concurrently with a regulating button; since the damping columns are closer to the jack than the regulating buttons, the jack turns at a larger angular velocity so that the hammer is not pinched between the jack and the hammer stopper; the damping columns are moved onto a virtual plane where the regulating buttons are so that the jacks are commonly used between the silent piano and the standard acoustic piano.

21 Claims, 11 Drawing Sheets

COMPOSITE KEYBOARD MUSICAL INSTRUMENT, SILENT SYSTEM FOR PERFORMANCE WITHOUT ACOUSTIC TONES AND REGULATING BUTTON MECHANISM FOR CHANGING ESCAPE TIMING DEPENDING UPON MODE OF OPERATION

FIELD OF THE INVENTION

This invention relates to a keyboard musical instrument and, more particularly, to a piano-based musical instrument, a silent system to be incorporated therein and a regulating button mechanism forming a part of the piano-based musical instrument for changing the escape timing depending upon the mode of operation.

DESCRIPTION OF THE RELATED ART

A piano-based musical instrument is operative in two modes of operation. One of the modes is selected for playing a piece of music on the keyboard by piano tones, and is hereinbelow referred to as "acoustic sound mode". When a pianist wishes to practice fingering on the keyboard without any piano tone, he or she will select the other mode. While the pianist is fingering a piece of music on the keyboard, the hammers rebound before striking the strings, and, accordingly, the strings do not generate the piano tones. If the pianist wants to confirm his or her fingering by electronic tones, the electronic sound generating system specifies the keys depressed and released by the pianist, and generates electronic tones corresponding to the piano tones through a headphone. The other mode is called as "silent mode", and the piano-based musical instrument is named "silent piano".

FIG. 1 shows a typical example of the silent piano. The silent piano is fabricated on the basis of an acoustic piano, and, accordingly, includes a keyboard 1, an action mechanism 2, hammers 3, a damper mechanism (not shown) and strings 4. The action mechanism includes plural action units, which are respectively linked with the black/white keys of the keyboard 1. When a black/white key is depressed, the depressed key actuates the associated action unit, which in turn drives the associated hammer 3 for rotation. The hammer 3 strikes the string 4 so as to give rise to vibrations, and the piano tone is generated through the vibrations of the string 4.

The action unit 2 includes a whippen assembly 2*a*, a jack 2*b* and a regulating button 2*c*. The whippen assembly 2*a* is connected at one end thereof to a whippen rail 2*d* by means of a whippen flange 2*e*, and is rotatable about the whippen flange 2*e*. The jack 2*b* is rotatably connected to the other end of the whippen assembly 2*a*, and has a leg and foot. The foot has a toe 2*f* and bump 2*g*, and the toe 2*f* is opposed to the regulating button 2*c*. On the other hand, the bump 2*g* is opposed to an auxiliary regulating button 2*h*. The regulating button 2*c* is hung from a regulating rail 2*i*, which is bolted to a shank flange rail. The shank flange rail is supported by action brackets 2*j* in such a manner than the regulating button 2*c* is on the trajectory of the toe 2*f*. As described hereinbefore, the depressed key actuates the action unit so that the whippen assembly 2*a* is driven for rotation about the whippen flange 2*e*. Accordingly, the jack 2*b* is rotated about the whippen flange 2*e* together with the whippen assembly 2*a*, and the toe 2*f* is getting close to the regulating button. When the toe 2*f* is brought into contact with the regulating button 2*c*, the reaction gives rise to rotation of the jack 2*b* about the whippen assembly 2*a*. Then, the jack 2*b* escapes from the hammer 3, and kicks it. This results in the free rotation of the hammer 3. The pianist depresses the black/white key against the total self-weight of the whippen assembly 2*a*, jack 2*b* and hammer 3, and feels the black/white key heavy. However, when the jack 2*b* escapes from the hammer 3, the hammer 3 does not exert any load against the key motion. For this reason, the pianist feels the black/white key light. Thus, the resistance against the key motion is changed at the escape. The change in resistance against the key potion is unique, and is called as "piano key touch".

The auxiliary regulating button 2*h* is hung from a shaft 2*k*, which is rotatably supported by the action brackets 2*j* by means of bearings 2*m*. Thus, the auxiliary regulating button 2*h* is swingable about the centerline of the shaft 2*k*, and, accordingly, is movable into and out of the trajectory of the bump 2*g*. The auxiliary regulating button 2*h* is assumed to be out of the trajectory of the bump 2*g*. The toe 2*g* is brought into contact with the regulating button 2*c* without any interference with the auxiliary regulating button 2*h*, and the jack 2*b* turns about the end portion of the whippen assembly 2*a* due to the reaction from the regulating button 2*c*. On the other hand, the auxiliary regulating button 2*h* is assumed to be moved into the trajectory of the bump 2*g*. The bump 2*g* is brought into contact with the auxiliary regulating button 2*h* concurrently with the contact between the toe 2*f* and the regulating button 2*c*, and the jack 2*b* turns about the end portion of the whippen due to the reaction from the auxiliary regulating button 2*h*. The jack 2*b* escapes from the hammer 3, and the hammer 3 starts the free rotation. Thus, the bump 2*g* and the auxiliary regulating button 2*h* cause the jack 2*b* to escape from the hammer 3 earlier than that escape therefrom due to the reaction from the regulating button 2*c*. The regulating buttons 2*c*, toes 2*f*, auxiliary regulating button 2*h* and bump 2*g* as a whole constitute the prior art regulating button mechanism.

The prior art regulating button mechanism offers two different escape timings to the jack 2*b*. This is because of the fact that the silent mode requires the early escape timing. In detail, a hammer stopper 5 is provided between the array of hammers 3 and the strings 4. The hammer stopper 5 is changed between a blocking position and a free position. When the hammer stopper 5 is in the free position, the hammer stopper 5 is out of the trajectories of the hammers 3, and strike the strings 4 without any interruption. On the other hand, when the hammer stopper 5 is in the blocking position, the hammer stopper 5 is on the trajectories of the hammers 3, and causes the hammers 3 to rebound thereon before the hammers 3 reach the strings 4. Thus, the hammer stopper 5 permits a pianist to play a piece of music without the piano tones.

When the hammer stopper 5 rests in the free position, the hammer 3 surely starts the free rotation after the escape. However, when the hammer stopper 5 is in the blocking position, the distance between the hammer 3 at the escape point and the hammer stopper 5 is very short. In fact, the distance is of the order of 2 millimeter in a standard grand piano. If action unit 2 causes the jack 2*b* to escape from the hammer later than usual, the hammer 3 reaches the hammer stopper 5 before completion of the escape, and is pinched between the jack 2*b* and the hammer stopper 5. The bump 2*g* and the auxiliary regulating button 2*h* cause the jack to escape from the hammer 3 earlier. The early escape is equivalent to a wide distance between the hammer 3 at the escape point and the hammer stopper 5. Thus, the bump 2*g* and the auxiliary regulating button 2*h* prevent the hammer from the undesirable stick.

Even if the auxiliary regulating button 2*h* and the bump 2*g* are removed from the prior art regulating button mechanism, the hammer 3 is prevented from the undesirable stick on the condition that the gap between the toe 2*f* and the regulating button 2*c* is decreased. However, the jack 2*b* escapes from the hammer 3 earlier regardless of the mode of operation. This results in that the pianist feels the key touch unusual.

As will be understood, the silent piano requires the change of escaping timing between the acoustic sound mode and the silent mode, and the bump 2*g* and the auxiliary regulating button 2*h* make the silent performance possible. However, a problem is encountered in the prior art silent piano in that prior art regulating button mechanism makes the retrofitting work from an acoustic piano to the silent piano difficult. In detail, users, who have already owned acoustic pianos, wish to retrofit their acoustic pianos to the silent piano. An electronic sound generating system, hammer stopper 5 and auxiliary regulating buttons 2*h* are added to the acoustic piano, and the standard jacks are replaced with the jacks 2*b*. Although the assemblage of the electronic sound generating system, hammer stopper 5 and auxiliary regulating buttons 2*h* is not difficult, the replacement from the standard jacks to the jacks 2*b* is time consuming, because the worker needs to disassembly the action units and reassemble the parts into the action units, again. The action units are equal in number to the black/white keys. In a standard grand piano, eighty-eight keys form the keyboard 1, and the assembly worker disassembles the eighty-eight action units and reassembles the jacks 2*b* and other parts into the eighty-eight action units. After the assembling work, the worker regulates the distance between the toes 2*f* and the regulating buttons 2*c* and the gaps between the bumps 2*g* and the auxiliary regulating buttons. Thus, a huge amount of work is required for the retrofitting, and causes the retrofit to the silent piano to be expensive.

The assignee/applicant, Yamaha Corporation, owns the invention disclosed in U.S. patent application No. 09/859, 760, European Patent Application No. 01112256.7, Korean Patent Application No. 10-2001-0027495 and Chinese patent Application No. 01122884.9, which were filed claiming the Convention Priority on the basis of Japanese Patent Application No. 2000-148717. The regulating button mechanism disclosed therein has a regulating bar connected to the change-over mechanism, and the distance between the jack and the regulating bar is regulated by using the adjusting mechanism. The adjusting mechanism projects into the space in front of the action mechanism so that a tuner easily adjusts the distance to appropriate value by using the adjusting mechanism. However, the bump are formed on the foot portion of the jack together with the toe, and the jack escapes from the hammer when either toe or bump is brought into contact with the regulating button or the regulating bar.

SUMMARY OF THE INVENTION

It is therefore an important object of the present invention to provide a silent piano, a regulating button mechanism of which cooperates with jacks identical with jacks of an acoustic piano.

It is also an important object of the present invention to provide a silent system, which is installed in an acoustic piano without changing jacks.

It is also an important object of the present invention to provide a regulating button mechanism, in which jacks of an acoustic piano are used as parts of the system.

To accomplish the object, the present invention proposes to make an inner portion of a standard jack brought into contact with a regulating member not later than contact timing between an outer portion of the jack and a regulating button.

In accordance with one aspect of the present invention, there is provided a composite keyboard musical instrument comprising an acoustic piano including a keyboard having plural keys selectively moved by a player positioned in front of the keyboard, plural action units respectively connected to the keys so as to be selectively actuated by the keys moved by the player and having jacks rotatable about axes of rotation, respectively, and a primary regulating member for producing first escapes of the jacks when first portions of the jacks are brought into contact with the primary regulating member, plural beating members respectively driven for rotation by the plural action units when the first escapes or second escapes are produced, plural vibratory members respectively struck with the plural beating members at the end of the rotation, and an auxiliary regulating button sub-mechanism including a secondary regulating member moved into the trajectories of the jacks and permitting second portions of the jacks closer to the axes of rotation than the first portions to be brought into contact therewith for the second escapes at certain timing not later than the contact between the first portions and the primary regulating member and a change-over mechanism connected to the secondary regulating member so as to move the secondary regulating member into and out of the trajectories of the jacks.

In accordance with another aspect of the present invention, there is provided a silent system installed in an acoustic piano for retrofitting the acoustic piano to a composite keyboard musical instrument comprising an auxiliary regulating button mechanism associated with an action mechanism of the acoustic piano and including a regulating member movable into trajectories of jacks of the acoustic piano and permitting inner portions of the jacks closer to axes of rotation for the jacks than outer portions of the jacks to be brought into contact therewith at a certain timing not later than the contact between the outer portions and regulating buttons of the acoustic piano and a change-over mechanism connected to the regulating member so as to move the regulating member into and out of the trajectories of the jacks, a hammer stopper associated with hammers of the acoustic piano, and changed between a free position out of trajectories of the hammer and an interference position on the trajectories of the hammers so as to cause the hammers to rebound thereon, and an electronic sound generating system associated with at least keys of the acoustic piano, and generating electronic tones corresponding to piano tones to be generated by depressing the keys.

In accordance with yet another aspect of the present invention, there is provided an auxiliary regulating button mechanism for accelerating escape of jacks forming a part of an action mechanism incorporated in an acoustic piano comprising a regulating member supported by a stationary member of the acoustic piano, and causing the jacks to escape from hammers of the acoustic piano when certain portions of the jacks are brought into contact therewith, the certain portions being closer to axes of rotations for the jacks than portions of the jacks to be brought into contact with regulating buttons of the action mechanism, and a change-over mechanism connected to the regulating member, and changing the regulating member between a first position out of the trajectories of the certain portions and a second position where the certain portions are brought into contact with the regulating member at a certain timing not later than a contact timing at which the portions are brought into contact with the regulating buttons.

BRIEF DESCRIPTION OF THE DRAWINGS

The features and advantages of the keyboard musical instrument, silent system and regulating button mechanism will be more clearly understood from the following description taken in conjunction with the accompanying drawings in which.

DESCRIPTION OF THE PREFERRED EMBODIMENTS

First Embodiment

Figure 1:
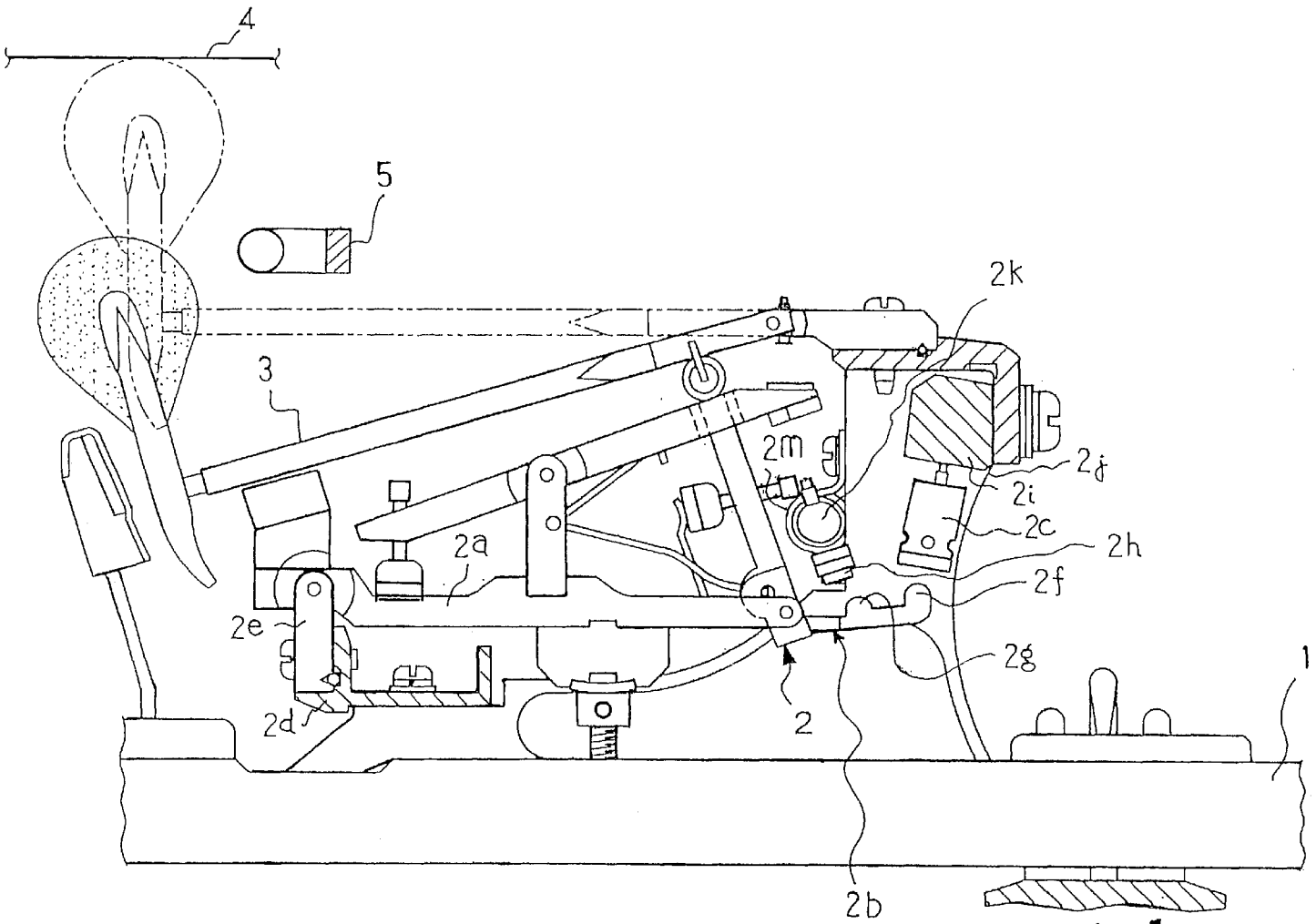
Fig. 1 PRIOR ART
FIG. 1 is a side view showing the structure of the prior art silent piano.
Figure 2:
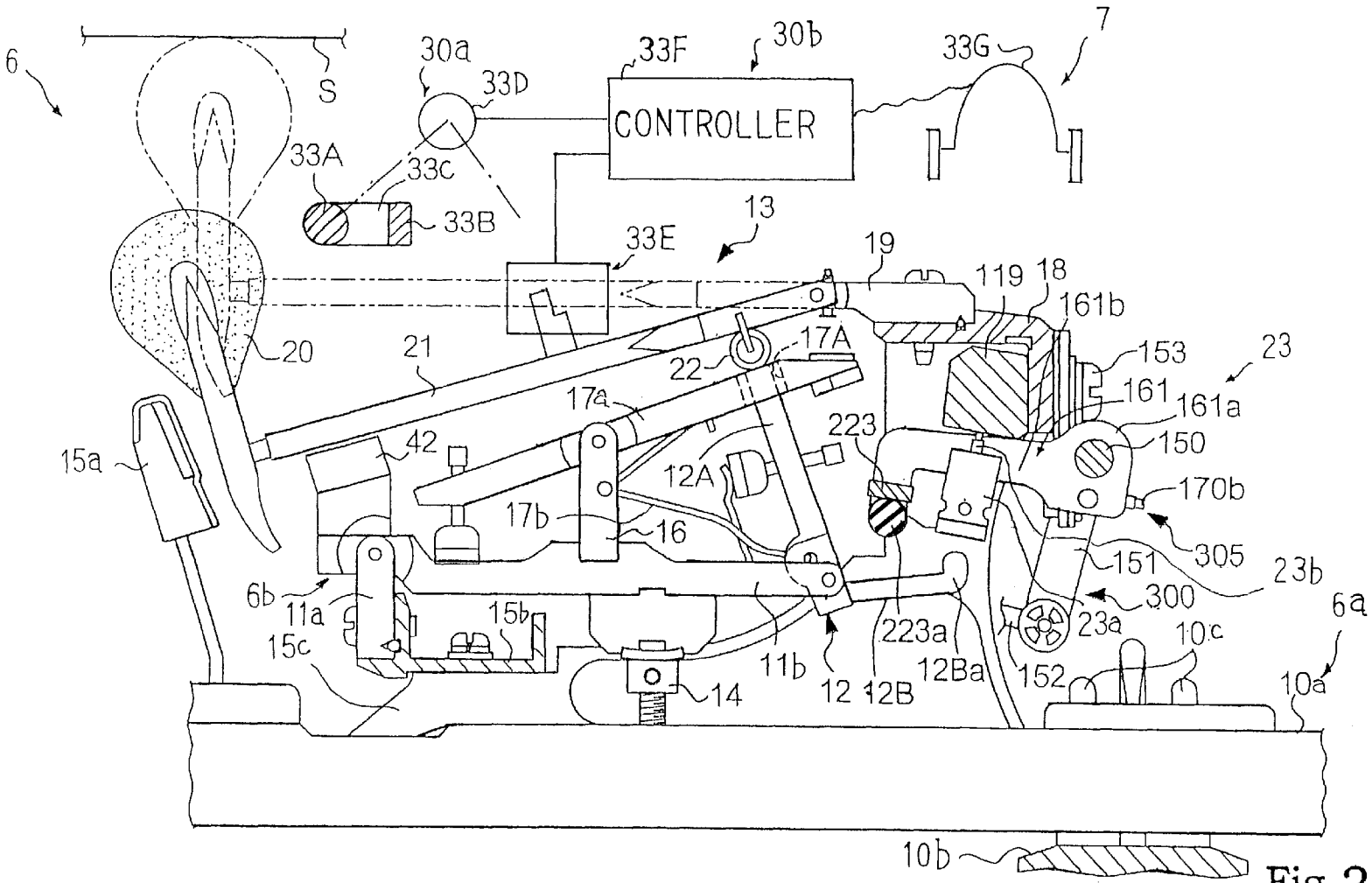
FIG. 2 is a side view showing the structure of an essential part of a silent piano according to the present invention in a free position.
Figure 3:
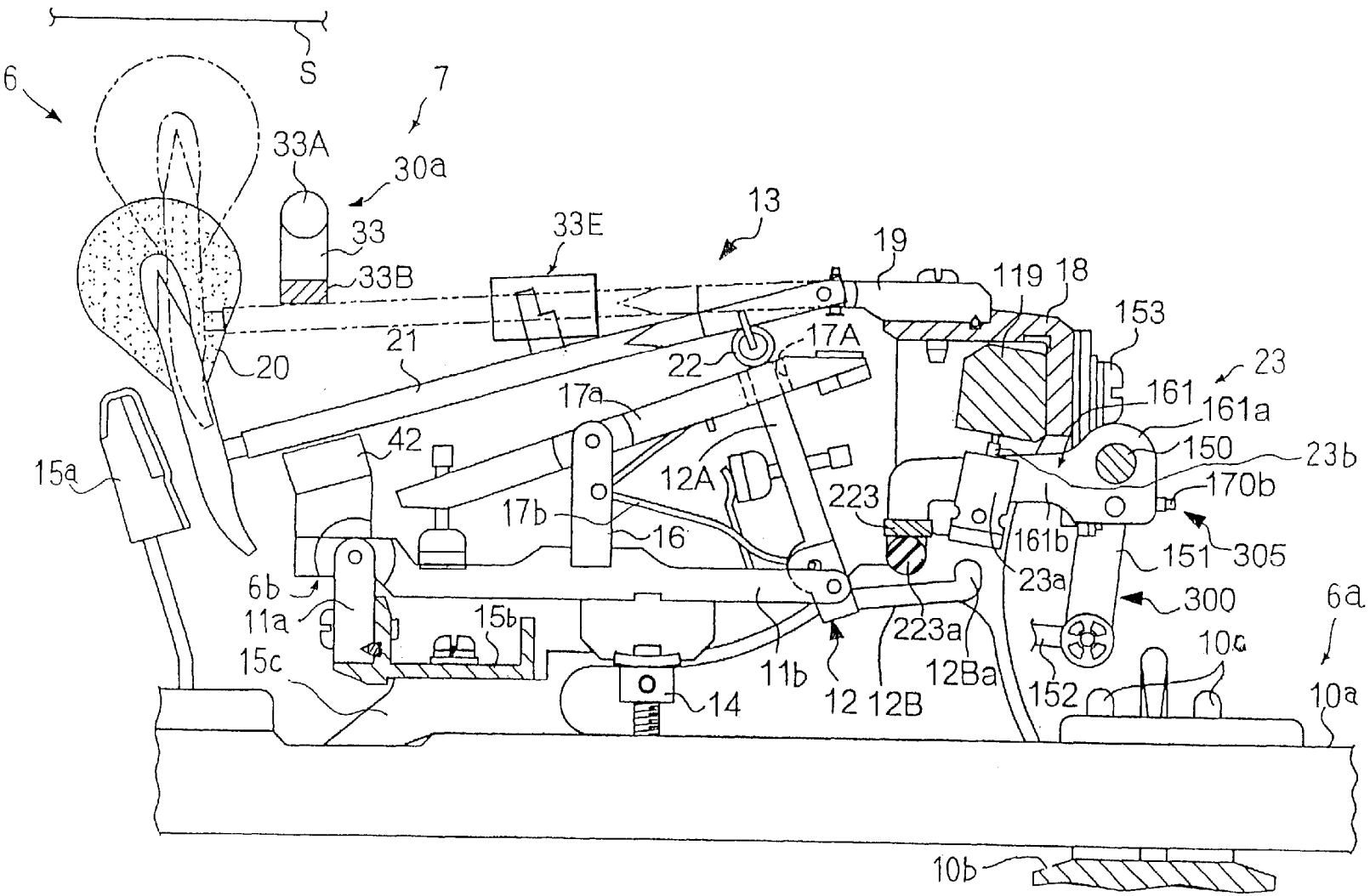
FIG. 3 is a side view showing the structure of the essential part of the silent piano in a blocking position.

Referring to FIGS. 2 and 3 of the drawings, a silent piano embodying the present invention largely comprises an acoustic piano 6 and a silent system 7. In this instance, the acoustic piano is a grand piano, and includes a keyboard 6*a*, an action mechanism 6*b*, hammer assemblies 13, a damper mechanism (not shown) and strings S. On the other hand, the silent system 7 includes a hammer stopper 30*a* and an electronic sound generating system 30*b*. While a pianist is fingering a piece of music on the keyboard 6*a*, the action mechanism 6*b* selectively drives the hammer assemblies 13 for rotation through the escape. If the hammer stopper 30*a* is in a free position, the hammer assemblies 13 strike the associated strings S, and the strings S vibrate for generating piano tones. On the other hand, if the hammer stopper 30*a* is in a blocking position, the hammer assemblies 13*a* rebound on the hammer stopper 30*a* without any interruption with the hammer stopper 30*a*, and return to the rest positions. The electronic sound generating system 30*b* monitors the hammer assemblies 13, and generates electronic tones corresponding to the piano tones to be generated. Thus, the silent piano selectively enters the acoustic sound mode (see FIG. 2) and the silent mode (see FIG. 3).

In the following description, term "front" modifies a position closer to a pianist sitting in front of the acoustic piano 6 than a position modified with term "rear". The "front" is on the right side in FIGS. 2 and 3, and the "rear" is on the left side in the figures. Term "lateral" is indicative of the direction normal to the papers where FIGS. 2 and 3 are drawn, and "fore-and-aft" direction is perpendicular to the lateral direction, i.e., the direction from the rear position to the front position.

The keyboard 6*a* is constituted by black keys and white keys 10*a*, and the action mechanism 6*b* has plural action units associated with the black/white keys 10*a*, respectively. The black/white keys 10*a* are laid on the well known pattern, and are arranged in the lateral direction. Each of the black/white keys 10*a* is rotatable with respect to a balance rail 10*b* by means of a balance pin 10*c*. The black/white keys 10*a* are associated with the damper mechanism (not shown) as well as the action mechanism 6*b*. A capstan button 14 projects from the rear portion of each black/white key 10*a*, and is held in contact with the associated action unit. A back check 15*a* is fixed to the rear end portion of the black/white key 10*a*, and is upright thereon. The back check 15*a* receives the associated hammer assembly 13, which has rebounded on the associated string S or the hammer stopper 30*a*. When a pianist exerts force on the front portion of the black/white keys 10*a*, the front portion is sunk, and, accordingly, the rear portion is raised. Then, the depressed key 10*a* actuates the associated action unit through the capstan button 14, and spaces the associated damper from the string S. Thus, the force is transmitted through the depressed key 10*a* to the associated damper as well as the associated action unit.

The action units are supported by a whippen rail 15*b*, which in turn is supported by action brackets 15*c*. The action brackets 15*c* are provided on a key frame (not shown), and are spaced from one another in the lateral direction. Each of the action units includes a whippen flange 11*a*, a whippen assembly 11*b*, a jack 12, a repetition lever flange 16, a repetition lever 17*a* and a repetition spring 17*b*. The whippen flange 11*a* is fixed to the whippen rail 15*b*, and is upright thereon. The whippen assembly 11*b* is swing ably connected at the rear end portion thereof to the whippen flange 11*a*, and the capstan button 14 is held in contact with the lower surface of the whippen assembly 11*b*. The repetition lever flange 16 is fixed to the intermediate portion of the whippen assembly 11*b*, and is upright on the whippen assembly 11*b*. The repetition lever 21 is rotatably connected to the upper end portion of the repetition lever flange 16.

The jack 12 is rotatably connected to the front end portion of the whippen assembly 11*b* at a bent portion by means of a pin, and has a relatively long leg portion 12A and a relatively short foot portion 12B. A hole 17A is formed in the front portion of the repetition lever 17*a*, and the relatively long leg portion 12A is inserted into the hole 17A. The repetition spring 17*b* is provided between the repetition lever 17*a* and the jack 12, and urges the jack 12 in the counter clockwise direction at all times. A toe 12Ba is formed in the relatively short foot portion 12B. Any bump is not formed. The upper surface of the relatively short foot portion 12B is flat between the bent portion and the toe 12Ba. Thus, the jack 12 is same as the jack of a standard grand piano. A tandem regulating button mechanism 23 makes the jacks 12 escape from the associated hammer assemblies 13 as will be described hereinafter in detail.

A shank flange rail 18 is supported by the action brackets 15*c*, and extends in the lateral direction. The hammer assemblies 13 are swingably supported by the shank flange rail 18, and rearward project therefrom. The hammer assembly 13 includes a hammer shank flange 19, a hammer head 20, a hammer shank 21 and a hammer roller 22. The hammer shank flange 19 is fixed to the shank flange rail 18 by means of a bolt, and the hammer shank 21 is swingably connected to the hammer shank flange 19. The hammer head 20 is fixed to the leading end of the hammer shank 21, and is directed to the associated set of strings S. The hammer roller 22*d* is connected to the hammer shank 21, and downwardly projects from the lower surface of the hammer shank 21. Although the leading end of the leg portion 12A is held in contact with the hammer roller 22 until an escape of the jack 12, the hammer roller 22 is left from the leg portion 12A after the hammer assembly 13 starts the free rotation. Upon striking the set of strings S, the hammer head 20 rebounds on the set of strings S, and the hammer head 20 is received by the back check 15*a*. After the depressed key 10 is released, the leg portion 12A is brought into contact with the hammer roller 22, again.

A regulating rail 119 is fixed to the shank flange rail 18 by means of bolts 153, and extends in the lateral direction. The tandem regulating button mechanism 23 is supported by the shank flange rail 18, and is located over the array of jacks 12. The tandem regulating button mechanism 23 includes plural regulating buttons 23*a*, plural regulating bars 223, damping columns 223*a*, a change-over mechanism 300 and an adjusting mechanism 305. The regulating buttons 23*a* form parts of the action units, respectively. On the other hand, the plural regulating bars 223, damping columns 223*a*, a change-over mechanism 300 and an adjusting mechanism 305 as a whole constitute an auxiliary regulating button sub-mechanism, which is incorporated in the silent system 7.

The regulating bars 223 are provided in the spaces between the action brackets 15*c*. The regulating bars 223 may be implemented by a single regulating bar or plural sets of regulating bars. In this instance, the black/white keys 10 are divided into three pitched parts, i.e., a higher pitched part, middle pitched part and lower pitched part, and a pair of regulating bars 223 is assigned to each of the three pitched parts. Accordingly, six regulating bars 223 are incorporated in the auxiliary regulating button sub-mechanism. The damping columns 223*a* are fixed to the lower surfaces of the regulating bars 223, respectively, and are opposed to certain areas of the upper surfaces of the relatively short foot portions 12B of the jacks 12. The certain area is almost the middle of the upper surface between the bent portion and the toe 12Ba. The adjusting mechanism 305 is provided for the regulating bars 223, and is used for regulating the gap between the damping columns 223*a* and the upper surfaces of the associated jacks 12 as will be described in detail hereinafter.

The regulating buttons 27*b* are hung from the regulating rail 23*a* by means of screws 23*b*, and are opposed to the toes 12Ba of the associated jacks 12. The gap between each of the regulating buttons 23*a* and the associated toe 12Ba is variable by turning the regulating button 23*a* around the screw 23*b*.

A pianist is assumed to depress the black/white key 15*a*. The capstan button 14 upwardly pushes the whippen assembly 11*b*, and gives rise to rotation of the whippen assembly 11*b* around the whippen flange 11*a* in the counter clockwise direction. The jack 12 is rotated together with the whippen assembly 11*b* without any relative rotation to the whippen assembly 11*b*. The leg portion 12A pushes the hammer roller 22, and gives rise to rotation of the hammer shank 21 and the hammer head 20 around the hammer shank flange 19. When the toe 12Ba is brought into contact with the associated regulating button 23*a*, the reaction from the regulating button 23*a* gives rise to the rotation of the jack 12 about the whippen assembly 11*b*. Then, the jack 12 escapes from the hammer roller 22, and the leg portion 12A kicks the hammer roller 22. The escape gives rise to the free rotation of the hammer assembly 13, and the hammer head 20 rebounds on either hammer stopper 30*a* or strings depending upon the mod of operation.

The tandem regulating button mechanism 23 forms a part of the silent system 7 except the regulating buttons 23*a*. For this reason, the regulating bars 223, the damping columns 223*a*, the change-over mechanism 300 and the adjusting mechanism 305, i.e., the auxiliary regulating button sub-mechanism is hereinlater described in detail together with the hammer stopper 30*a* and the electronic sound generating system 30*b*.

Firstly, the hammer stopper 30*a* and electronic sound generating system 30*b* are briefly described. The hammer stopper 30*a* includes a shaft 33A, impact absorbers 33*b*, brackets 33*c* and an actuator 33*d*. The shaft laterally extends over the hammer shanks 21, and is connected to the actuator 33D at one end thereof. The brackets 33C are fixed to the shaft 33A at intervals, and the impact absorbers 33B are secured to the brackets 33C, respectively. In this instance, the actuator 33D is implemented by an electric motor. The electric motor 33D keeps the impact absorbers 33B frontward directed as shown in FIG. 2. The hammer stopper 30*a* is out of the trajectories of the hammer shanks 21, and, accordingly, is in the free position. The actuator 33D rotates the shaft 33A in the clockwise direction. Then, the impact absorbers 33B enter the trajectories of the hammer shanks 21, and the hammer stopper 30*a* is changed to the blocking position.

The electronic sound generating system 30*b* includes plural key sensors (not shown), plural hammer sensors 33E, a controller 33F and a sound system having a headphone 33G. The key sensors (not shown) are provided under the keyboard 6*a*, and report the current key positions of the associated black/white keys 10 to the controller 33F. On the other hand, the hammer sensors 33F are respectively associated with the hammer assemblies 13, and report the current hammer positions of the associated hammer assemblies 13 to the controller 33F. The controller 30*b* includes a data processor and a tone generator. The key sensors and the hammer sensors 33E are connected in parallel to an interface of the data processor, and the data processor analyzes the key motion and hammer motion on the basis of the current key positions and current hammer positions for producing music data codes. The music data codes are supplied to the tone generator. The tone generator generates an analog audio signal from the music data codes, and supplies the analog audio signal to the headphone 33G. The headphone 33G converts the analog audio signal to the electronic tones.

As described hereinbefore, the damping columns 223*a* are respectively secured to the lower surfaces of the regulating bars 223, and are moved into and out of the trajectories of the upper surfaces of the foot portions 12B. The change-over mechanism 300 keeps the damping columns 223*a* out of the trajectories of the foot portions 12B in the free position, and the toes 12Ba are brought into contact with the regulating buttons 23*a* before the upper surfaces reach the damping columns 223*a*. When the change-over mechanism 300 is manipulated for the blocking position, the damping columns 223*a* are moved into the trajectories of the foot portions 12B, and the upper surfaces of the foot portions 12B and the toes 12Ba are concurrently brought into contact with the damping columns 223*a* and the regulating buttons 23*a*, respectively. The gaps between the toes 12Ba and the regulating buttons 23*a* are adjusted in such a manner that the pianist feels the key touch same as that of the standard grand piano. The reaction from the damping column 223*a* gives rise to the rotation of the jack 12 larger in angular velocity than the rotation of the jack 12 in the acoustic sound mode, because the certain area on the upper surface is closer to the bent portion than the tow 12Ba is. Thus, the damping columns 223*a* and the upper surfaces of the foot portions 12B accelerate the escape of the jacks 12 from the hammer assemblies 13, and prevent the hammer shanks 21 from being pinched between the jacks 12 and the impact absorbers 33B. In other words, the damping columns 223*a* and the foot portions 12B make the distance between the hammer head 20 at the completion of the escapes and the string S wider than the distance in the prior art silent piano.

The damping columns 223*a* have a circular cross section, and are formed of resilient material. The damping columns 223*a* may be formed from fiber strings. Otherwise, the damping columns 223*a* may be formed of felt, sponge cellular rubber or cloth. Thus, the damping columns 223*a* are resiliently deformable, and take up the noise at the contact with the foot portions 12B.

Figure 4:
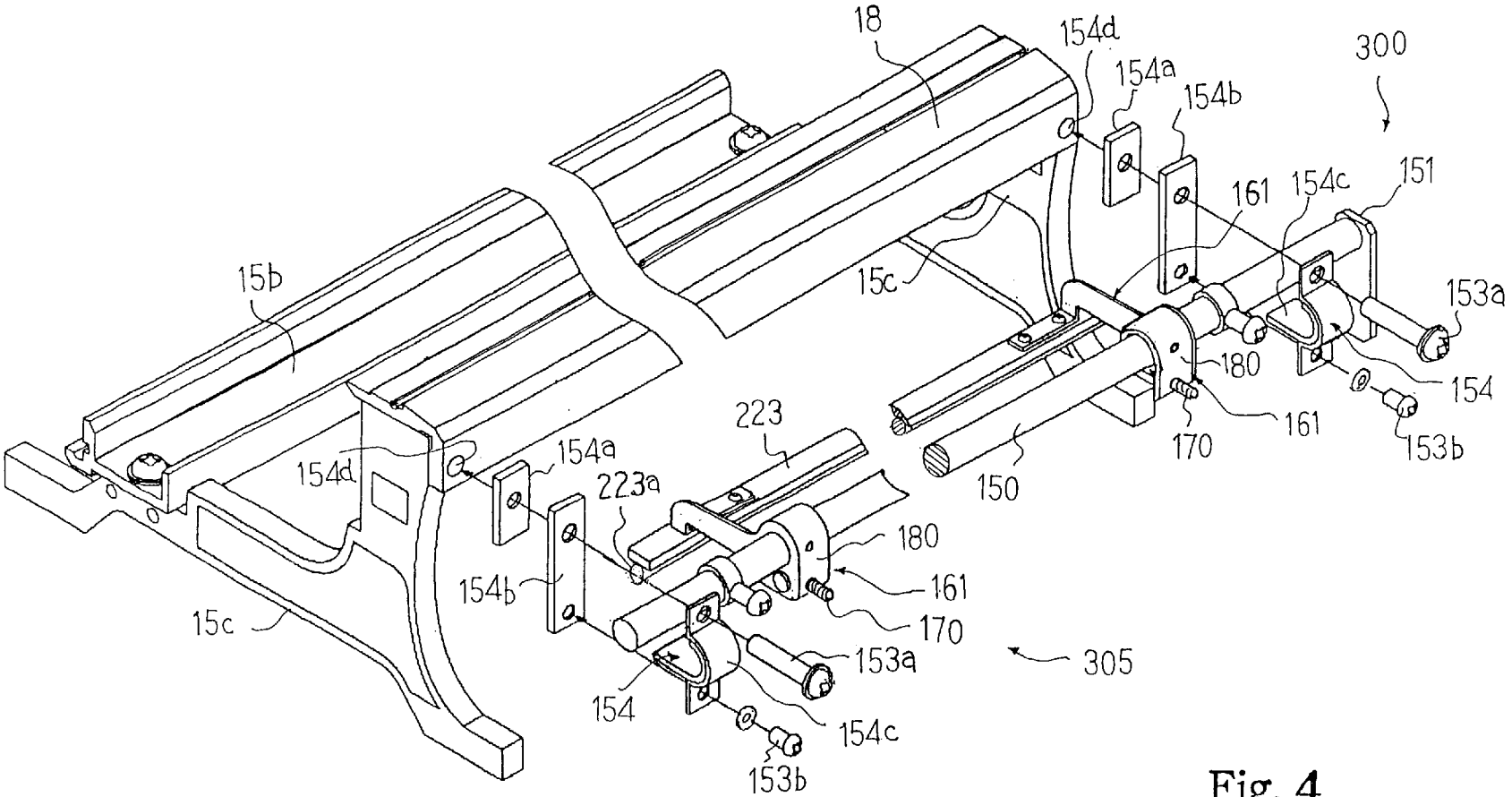
FIG. 4 is a fragmentary perspective view showing the structure of a change-over mechanism incorporated in a silent system.
Figure 5:
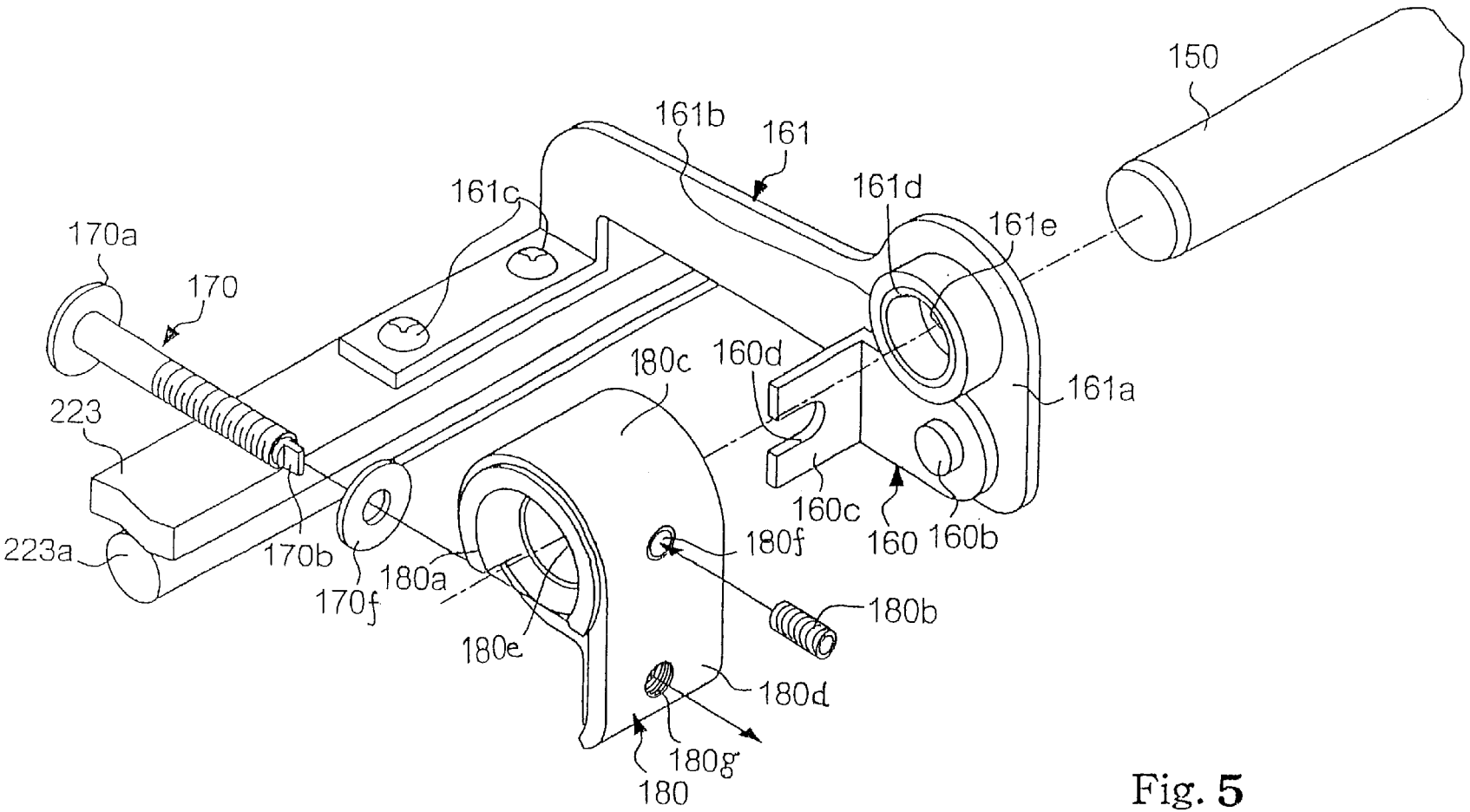
FIG. 5 is a fragmentary perspective view showing the structure of a retainer forming a part of the change-over mechanism.
Figure 6:
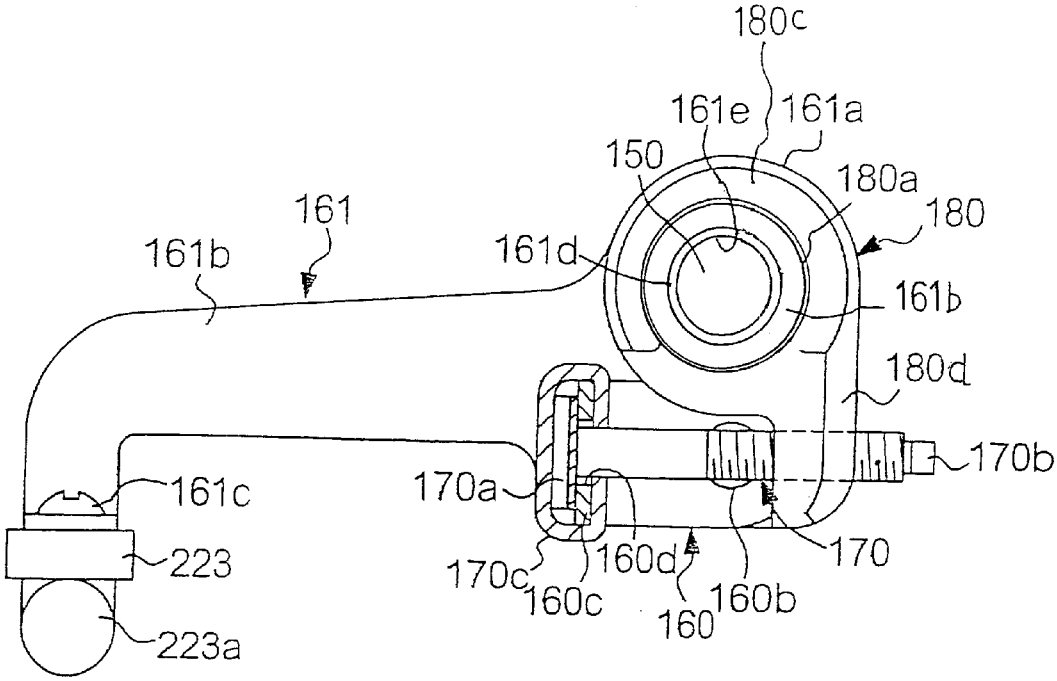
FIG. 6 is a partially cut-away front view showing an adjusting mechanism built in the retainer.

Description is hereinbelow made on the change-over mechanism 300 and the adjusting mechanism 305 with reference to FIGS. 4, 5 and 6. The change-over mechanism 300 is provided in the space under the regulating rail 119, and is connected to the regulating bars 223. The change-over mechanism 300 is used for concurrently changing the regulating bars 223 between a first angular position and a second angular position. The damping columns 223*a* at the first angular position are out of the trajectories of the foot portions 12B. However, when the change-over mechanism is manipulated for the second angular position, the damping columns 223*a* are moved into the trajectories of the foot portions 12B. Thus, the first angular position and the second angular position are corresponding to the free position and the blocking position, and the electric motor 33D is shared between the hammer stopper 30*a* and the change-over mechanism 300. When the electric motor 33D changes the hammer stopper 30*a* to the free position, the electric motor 33D causes the change-over mechanism 300 to change the damping columns 223*a* to the first angular position. Similarly, the electric motor 33D concurrently changes the hammer stopper 30*a* and the damping columns 223*a* to the blocking position and the second angular position.

The change-over mechanism 300 includes a shaft 150, bearing units 154, retainers 161 and a link work 151/152. The link work 151/152 is connected through a suitable rotation-to straight motion converter (not shown) to the electric motor 33D. Otherwise, the link work 151/152 and a link work of the hammer stopper 30*a* may be connected to a grip or a foot pedal so as to concurrently change the hammer stopper 30*a* and the change-over mechanism 300 between the free/first angular positions and the blocking/second angular positions.

The shaft 150 extends in the lateral direction, and is rotatably supported by the shank flange rail 18 by means of the bearing units 154. Each of the bearing units 154 has a short plate member 154*a*, a long plate member 154*b* and a cover plate member 154*c*. The length of the short plate member 154*a* is approximately equal to the width of the front surface of the shank flange rail 18, and a through-hole is formed in the short plate member 154*a*. The long plate member 154*b* is approximately equal in length to the cover plate member 154*c*, and the cover plate member 154*c* has a generally Ω-letter shape. Two through-holes are formed in the long plate member 154*b*, and two through-holes are also formed in both side portions of the cover plate member 154*c*. The through-holes in the long plate member 154*b* are spaced equally to the through-holes formed in the cover plate member 154*c*, and, accordingly, are aligned therewith. A pair of female bolt holes 154*d* is formed in the shank flange rail 18, and is open to both side areas of the front surface of the shank flange rail 18. The short plate member 154*a*, the long plate member 154*b* and the cover plate member 154*c* are laminated on the front surface of the shank flange rail 18, and the shaft 150 is sandwiched between the long plate members 154*b* and the cover plate member 154*c*. The through-hole in the short plate member 154*a*, the upper through-hole in the long plate member 154*b* and the upper through-hole of the cover plate member 154*c* are aligned with the female bolt hole 154*d*, and a long bolt 153*a* is screwed into the female bolt hole 154*d*. A short bolt 153*b* is further screwed into the through-hole in the long plate member 154*b* and the through-hole in the cover plate member 154*c*. The short plate members 154*a*, long plate members 154*b* and cover plate members 154*c* are assembled into the bearing units 154, which are bolted to the shank flange rail 18. Thus, the shaft 150 is rotatably supported by the shank flange rail 18 through the bearing units 154.

The link work 151/152 includes an arm 151 and a link member 152 (see FIGS. 2 and 3). The arm 151 is fixed at the upper end thereof to the shaft 150, and the link member 152 is rotatably connected to the lower end of the arm 151. The link member 152 in turn is connected through other link members to the rotation-to-straight motion converter. Otherwise, the link member 152 is connected to the grip or foot pedal.

The retainers 161 are supported by the shaft 150 at intervals, and rearward project from the shaft 150. Each pair of retainers 161 is associated with the regulating bar 223. The rear end portions of the retainers 161 are fixed to both end portions of the regulating bar 223, and the damping column 223*a* is secured to the lower surface of the regulating bar 223.

Each of the retainers 161 has an arm plate 161*a*, a ring member 161*b*, bolts 161*c* and a bushing cloth 161*d*. A circular hole is formed in the arm plate 161*a*, and the ring member 161*b* is fixed to the arm plate 161*a* in such a manner as to align the circular hole with a through-hole 161*e* formed therein. The bushing cloth 161*d* is bonded to the inner surface of the ring member 161*b*, and the through-hole 161*e* has the inner diameter approximately equal to the outer diameter of the shaft 150. The shaft 150 passes through the circular hole and the through-hole 161*e*, and the bushing cloth 161*d* permits the retainers 161 to be smoothly rotated around the shaft 150. The arm plate 161*a* rearward projects from the shaft 150, and is fixed to the bracket regulating bars 223 by means of bolts 161*c*. Thus, the regulating bars 223 are supported by the shaft 150 by means of the retainers 161.

Figure 7:
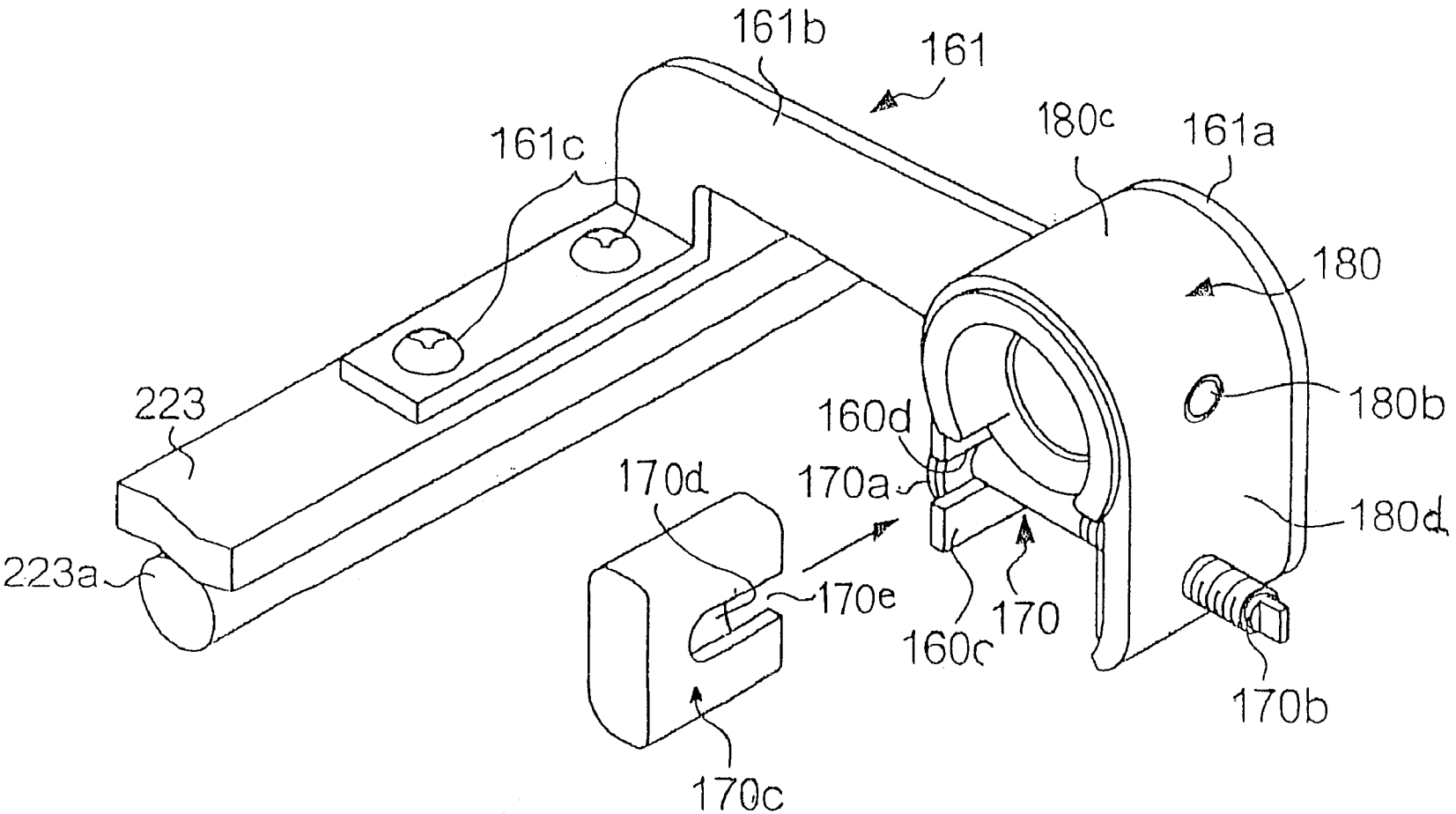
FIG. 7 is a perspective view showing the retainer and the adjusting mechanism.

The adjusting mechanism 305 includes rotatable angle members 160, regulating screws 170, stationary brackets 180, bracket set screws 180*b* and caps 170*c* (see FIG. 7). In this instance, the stationary bracket 180 slightly projects in the direction of the centerline of the shaft 150. The projecting portion is labeled with 180*a*. Thus, the stationary bracket 180 is wide enough to support the shaft stable. A pair of adjusting units is associated with each of the regulating bar 223. Each stationary bracket 180, each rotatable angle member 160, each regulating screw 170, each bracket set screw 180*b* and each cap 170*c* are assembled into one of the adjusting units provided at one end portion of the regulating bar 223, and another stationary bracket 180, another rotatable angle member 160, another regulating screw 170, another bracket set screw 180*b* and another cap 170*c* are assembled into another adjusting unit provided at the other end portion of the regulating bar 223. Thus, the pair of adjusting units is provided at both end portions of each of the regulating bars 223. The adjusting units are identical in structure to one another, and only the adjusting unit provided on the right side is hereinbelow detailed.

The pair of adjusting units gives rise to relative rotation between the retainers 161 and the shaft 150 for changing the gap between the foot portions 12B and the associated damping column 223*a*. As described hereinbefore, the retainer 161 is broken down into the arm plate 161*a*, the ring member 161*b* and the bolts 161*c*. The stationary bracket 180 has a shape like numeral letter "9", and is broken down into a ring portion 180*c* and a flat portion 180*d*. A through-hole is formed in the ring portion 180*c*. The ring portion 180*c* is formed with a through-hole 180*e*, and the through-hole 180*e* is slightly larger in diameter than the ring member 161*b*. For this reason, when the stationary bracket 180 is assembled with the retainer 161, the ring portion 161*b* is rotatably received in the through-hole 180*e* of the ring portion 180*c*. The ring portion 180*c* is wider than the ring member 161*b*, and the left side surface of the ring member 161*b* is retracted into the through-hole 180*e*. The through-hole 180*e* is coincident with the through-hole 161*e*, and the shaft 150 passes the through-hole 161*e*.

A bolt hole 180*f* is further formed in the ring portion 180*c*, and the bracket set screw 180*b* is screwed into the bolt hole 180*f* The bracket set screw 180*b* is pressed against the shaft 150, and the reaction makes the stationary bracket 180 pressed against the shaft 150. Thus, the stationary bracket 180 is secured to the shaft 150 by means of the bracket set screw 180*b*. Accordingly, the stationary bracket 180 and the shaft 150 do not change the relative position after assembling together.

A bolt hole 180*g* is formed in the flat portion 180*d*, and the regulating screw 170 frontward projects from the flat portion 180*d*. The regulating screw 170 has a threaded stem portion, a head portion 170*a* and a thin edge portion 170*b*. The threaded stem portion is screwed into the bolt hole 180*g*. The thin edge portion 170*b* frontward projects from the plate portion 180*d*.

The angle member 160 is rotatably connected to the arm plate 161*a* by means of a pin 160*b*, and the pin 160*b* has a centerline offset from the centerline of the through-hole formed in the ring member 161*b*. The angle member 160 has a projecting portion 160*c*, which project from the remaining portion held in contact with the arm member 161*a*. A slit 160*d* is formed in the projecting portion 160*c*, and is open to the left side. The slit 160*d* has a width slightly larger than the diameter of the threaded stem portion of the regulating screw 170, but is smaller than the diameter of the head portion 170*a*. When the stationary bracket 180 is secured to the shaft 150, the projecting portion 160*c* is opposed to the flat portion 180*d*, and the slit 160*d* is aligned with the bolt hole 180*g*. For this reason, the regulating screw 170 passes the slit 160*d*, and is screwed into the bolt hole 180*g*. Thus, the regulating screw 170 is supported at the front end thereof by the stationary bracket 180 and at the boss portion thereof by the rotatable angle member 160.

The thin edge portion 170*b* projects into the relatively wide space in front of the action mechanisms 6*b*, and a tuner is able to easily turn the regulating screw 170 with a suitable tool engaged with the thin edge portion 170*b*.

An inner space 170*d* is defined in the cap 170*c*, and is exposed to the outside through a slit 170*e*. The width of the inner space 170*d* is approximately equal to the total thickness of the head portion 170*a*, a bushing cloth 170*f* and the projecting portion 160*c*. When the cap 170*c* is pushed toward the head portion 170*a* which have been already supported by the rotatable angle member 160 and the flat portion 180*d*, the head portion 170*a*, the bushing cloth 170*f* and the projecting portion 160*c* are received in the inner space 170*d* of the cap 170*c*. Thus, the head portion 170*a* and the rotatable angle member 160 are bound together by means of the cap 170*c*, and the cap 170*c* prevents the regulating screw 170 from dropping from the rotatable angle member 160.

Assuming now that a tuner turns the regulating screws 170 so as to widen the gap between the rotatable angle members 160 and the flat portions 180*d* of the stationary brackets 180, the head portions 170*a* are rearward moved, and push the rotatable angle members 160 through the caps 170*c*, because the bracket set screws 180*b* prohibit the stationary brackets 180 from rotation around the centerline of the shaft 150. The force gives rise to not only the rotation of the rotatable angle members 160 around the pins 160*b* but also the rotation of the arm members 161 around the shaft 150. The retainers 161 are rotated in the clockwise direction in FIG. 5 together with the regulating bar 223. This results in increase of the gap between the damping column 223*a* and the foot portions 12B of the associated jacks 12.

On the other hand, when the tuner decreases the gap between the damping column 223*a* and the foot portions 12B, the tuner turns the regulating screws 170 in the opposite direction, and decreases the gap between the rotatable angle members 160 and the flat portions 180*d*. The stationary bracket members 180 do not change the relative position to the shaft 150. The regulating screws 170 are further screwed into the bolt holes 180*g*. The head portions 170*a* push the rotatable angle members 160 toward the flat portions 180*d* by means of the caps 170*c*, and the arm members 161*a* are driven for rotation in the counter clockwise direction. Thus, the tuner decreases the gap between the damping column 223*a* and the foot portions 12B by means of the adjusting units.

When a pianist wishes to play a piece of music by the piano tones, he or she instructs the electric motor 33D to rotate the output shaft in order to change the hammer stopper 30*a* and the damping columns 223*a* to the free position and the first angular position, respectively. The shaft 33A is driven for rotation, and the impact absorbers are moved out of the trajectories of the hammer shanks 21. On the other hand, the link member 152 is rearward pulled, and the regulating lever 151 is rotated in the clockwise direction in FIGS. 2 and 3. The rotation is transmitted through the shaft 150 and the retainers 161 to the regulating bars 223, and the damping columns 223*a* are moved out of the trajectories of the foot portions 12B. Thus, the silent piano is changed to an acoustic sound mode, and the pianist gets ready for the performance.

The pianist selectively depresses the black/white keys 10*a* for the performance. While the pianist is playing the piece of music on the keyboard 6*a*, the pianist is assumed to depress one of the black/white key 10*a* shown in FIG. 2. The front portion of the black/white key 10*a* is sunk, and, accordingly, the rear portion is lifted. The capstan button 14 pushes the whippen assembly 11*b*, and gives rise to the rotation of the whippen assembly 11*b* in the counter clockwise direction about the whippen flange 11*a*. The jack 12 is also rotated about the whippen flange 11*a* without any relative rotation to the whippen assembly 11*b*, and pushes the hammer roller 22. The toe 12Ba is getting closer and closer to the regulating button 23*a*. The toe 12Ba reaches the regulating button 23*a* earlier than the upper surface of the foot portion 12B reaches the damping column 223*a*. When the toe 12Ba is brought into contact with the regulating button 23*a*, the reaction gives rise to the rotation of the jack 12 around the front end portion of the whippen assembly 11*b* in the clockwise direction. The jack 12 escapes from the hammer roller 22 at a relatively low speed, and the leg portion 12A kicks the hammer roller 22. Thus, the escape gives rise to the free rotation of the hammer assembly 13 in the clockwise direction. The hammer assembly 13 is moved on the trajectory, and the impact absorber 33B is out of the trajectory. For this reason, the hammer head 20 reaches the associated set of strings S without any interruption of the hammer stopper 30*a*. The hammer head 20 strikes the set of strings S. The strings S vibrate, and generate the piano tone.

The hammer head 20 rebounds on the set of strings S, and the back check 15*a* receives the hammer assembly 13. When the pianist releases the depressed key 10*a*, the capstan button 14 is sunk together with the rear portion of the released key 10*a*, and permits the whippen assembly 11*b* to be rotated in the clockwise direction. Accordingly, the toe 12Ba is spaced from the regulating button 23*a*, and the leg portion 12A slides into the space beneath the hammer roller 22.

When the pianist wishes to practice the fingering on the keyboard 6*a* without any piano tone, he or she instructs the electric motor 33D to rotate the output shaft in the opposite direction. The shaft 33A is driven for rotation in the clockwise direction, and the impact absorbers 33*b* enter into the trajectories of the hammer shanks 21. Moreover, the link member 152 is frontward pushed, and the lever 151 is driven for rotation in the counter clockwise direction. The damping columns 223*a* enter into the trajectories of the foot portions 12B, and are opposed thereto. Thus, the silent piano is changed to the silent mode of operation.

While the pianist is fingering on the keyboard 6*a*, he or she is assumed to depress the black/white key 10*a* shown in FIG. 3. The depressed key 10*a* causes the capstan button 14 to push the whippen assembly 11*b*, upwardly. The whippen assembly 11*b* is rotated about the whippen flange 11*a*. The foot portion 12B gets closer and closer to the damping column 223*a* and the regulating button 23*a*. The toe 12Ba and the certain area on the upper surface of the foot portion 12B are concurrently brought into contact with the regulating button 23*a* and the damping column 223*a*, and the reaction from the damping column 223*a* gives rise to the quick rotation of the jack 12 about the front end portion of the whippen assembly 11*b*. The jack 12 escapes from the hammer roller 22 at a relatively high speed, because the angular velocity at the certain area is larger than the angular velocity at the toe 12Ba. The hammer assembly 13 starts the free rotation, and rebounds on the impact absorber 33B before striking the set of strings S. Thus, although the jack 12 escapes from the hammer assembly 13 in the silent mode at the same timing as the jack 12 in the acoustic sound mode, the jack 12 completes the escape in the silent mode earlier than the jack 12 completes it in the acoustic sound mode. While the jack 12 is escaping from the hammer roller 22, the whippen assembly 11*b* is further rotated, and, accordingly, the leg portion 12A is moved upwardly. The leg portion 12A is merely moved over a short distance in the silent mode. The distance over which the leg portion 12A is moved in the silent mode is less than the distance over which the leg portion 12A is moved in the acoustic sound mode, because the jack 12 completes the escape earlier than that in the acoustic sound mode. This results in that the jack 12 is less liable to be pinched between the hammer stopper 30*a* and the jack 12. Moreover, the escape starts at the certain point on the trajectory of the depressed key 10*a* in both acoustic sound and silent modes, and the piano key touch in the silent mode is same as that in the acoustic sound mode.

When the pianist depresses the black/white key 10*a*, the key sensor (not shown) and the hammer sensor 33*e* start the monitoring, and supply the key position signal and the hammer position signal to the data processor of the controller 33F. The data processor specifies the depressed key 10*a* on the basis of the key/hammer position signal, and calculates the hammer velocity immediately before the hammer assembly 13 rebounds on the impact absorber 33B. The data processor stores these pieces of music data information in music data codes such as, for example, MIDI (Musical Instrument Digital Interface) data codes. When the hammer assembly 13 passes a predetermined point immediately before the rebound, the data processor supplies the music data codes representative of the key code assigned to the depressed key 10*a*, the note-on event and the hammer velocity to the tone generator. The tone generator produces the audio signal, and supplies it to the headphone 33G. The headphone 33G converts the audio signal to the electronic tone, and the pianist confirms the fingering through the electronic tone.

When the pianist releases the depressed key 10*a*, the released black/white key 10*a* returns toward the rest position. The released key 10*a* passes a predetermined position on the way toward the rest position. Then, the data processor supplies the music data codes representative of the key code and the note-off event to the tone generator. The tone generator makes the electronic tone decayed.

Figure 8A:
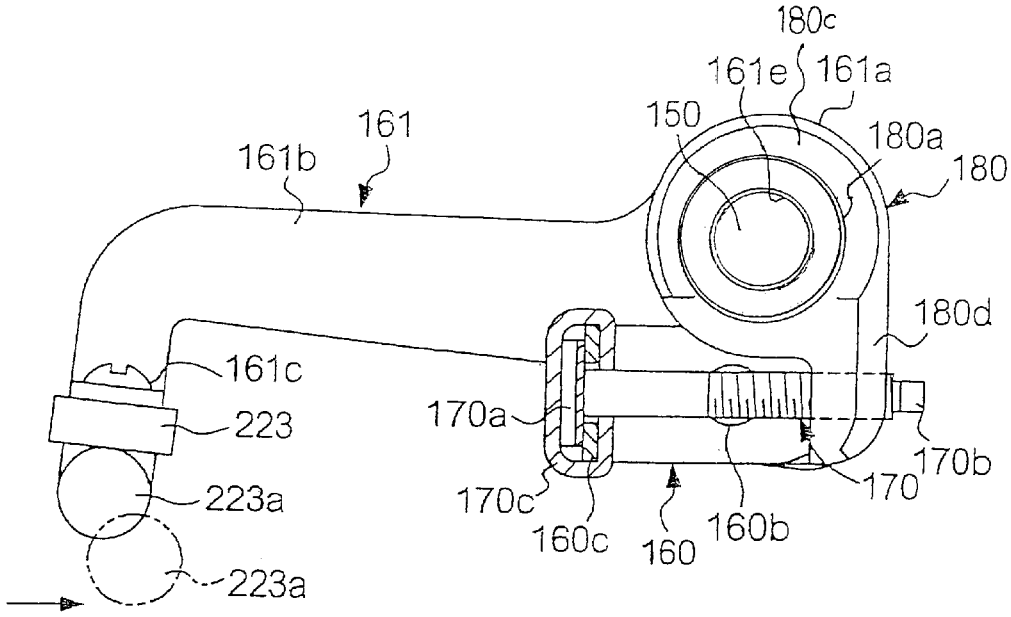
FIGS. 8A and 8B are side views showing damping columns for which a tuning is required.

The silent piano is assumed to have been used for a long time. The damping columns 223*a* are unintentionally moved from the appropriate position to a position indicated by dots-and-dash lines in FIG. 8A, and the escape in the silent mode becomes earlier than the escape in the acoustic sound mode. The user notifies the key-touch to be unusual. A tuning is required.

In this situation, the damping columns 223*a* are to be upwardly moved from the present position. A tuner accesses the space in front of the action mechanism 6*b* without taking out to a working table, and turns the thin edge portions 170*b* in such a manner that the head portions 170*a* are rearward moved. This results in that the distances between the head portions 170*a* and the flat portions 180*d* are increased. The head portions 170*a* exert force on the associated angle members 160 through the caps 170*c*. The pins 160*b* keep the angle members 160 in parallel to the regulating screws 170, and the tangential force components give rise to the rotation of the arm members 161 in the clockwise direction. Accordingly, the regulating bars 223 and the damping columns 223*a* are rotated in the clockwise direction, and return to the appropriate position indicated by real lines in FIG. 8A.

Figure 8B:
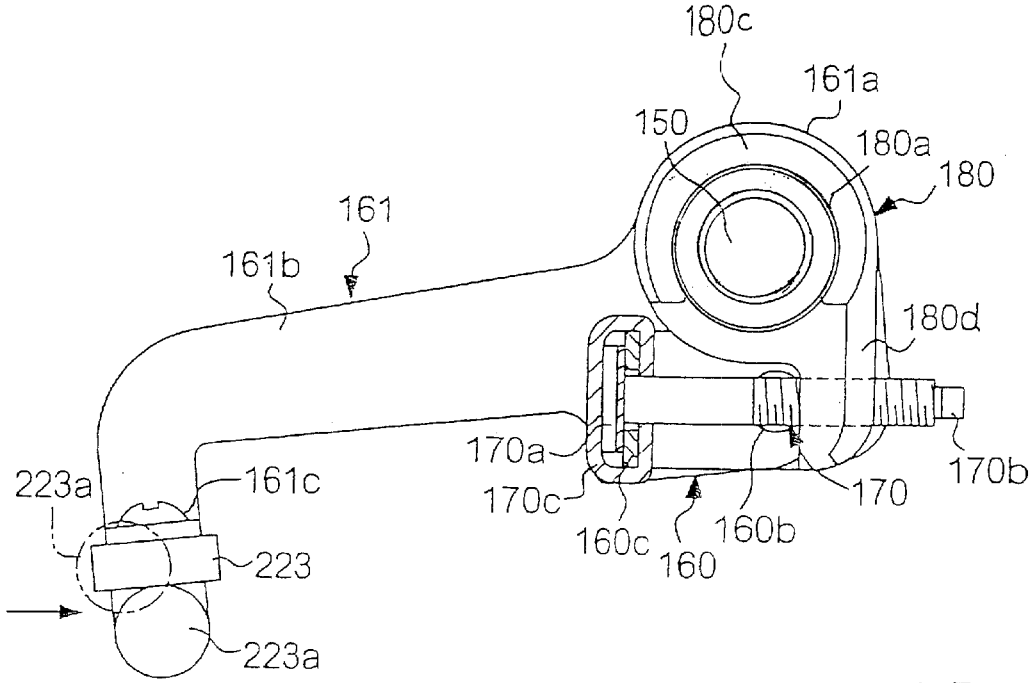

On the other hand, if the damping columns 223*a* are spaced from the appropriate position, and are at the position indicated by dots-and-dash lines in FIG. 8B. The completion of the escape in the silent mode becomes later. In the worst case, the hammer shank 21 is pinched between the jack 12 and the impact absorbers 33B. The damping columns 223*a* are to be moved downwardly.

The tuner accesses the thin edge portions 170*b* to the space in front of the action mechanism 6*b*, and turns the regulating screws 170 in such a manner that the thin edge portions 170*b* further project from the flat portions 180*d*. The distances between the head portions 170*a* and the flat portions 180*d* is reduced, and forces are exerted on the angle members 160 through the caps 170*c*. The pins 160*b* keep the angle members 160 in parallel to the regulating screws 170, and the tangential force components give rise to the rotation of the retainers 161 in the counter clockwise direction. Accordingly, the regulating bars 223 and damping columns 223*a* are rotated in the counter clockwise direction, and return to the appropriate positions.

The distance between the upper surfaces of the foot portions 12B and the damping columns 223*a* are varied depending upon the angle over which the regulating screws 170 turn. The tuner may repeat the tuning work shown in FIGS. 8A and 8B before adjusting the regulating bars 27*c* to the appropriate positions. However, the tuner does not need moving the action mechanism 6*b* to a working table. Thus, the tuning work becomes easier than the tuning work on the prior art silent piano.

As will be appreciated from the foregoing description, any special jack is not required for the tandem regulating button mechanism 23 according to the present invention. The jacks 12 are same as the jacks of a standard grand piano. When the manufacturer is requested to retrofit the grand piano to the silent piano, the manufacturer needs the hammer stopper 30*a*, electronic sound generating system 30*b* and the auxiliary regulating button sub-mechanism, only, and completes the retrofitting work within a relatively short time, because the workers do not change the jacks. If grand pianos are built by different manufacturers, the jacks are different in size and/or shape. Even so, the hammer stopper 30*a*, electronic sound generating system 30*b* and auxiliary regulating button sub-mechanism are standardized regardless of the differences among the jacks. Thus, the acoustic pianos are economically retrofitted to the silent piano.

Moreover, adjusting mechanism 305 according to the present invention is easy to manipulate. The adjusting mechanism 305 permits a tuner to adjust the damping columns 223*a* to the position where the jacks 120 are concurrently brought into contact with both of the damping columns 223*a* and regulating buttons 23*a* without taking out it to a working table. The worker quickly completes the tuning work.

Although the regulating screws 170 are reciprocally moved, the rotatable angle members 160 extract the tangential force components to be exerted on the retainers 161 from the force. The linear motion-to-rotation converting mechanism, i.e., the combination of the angle member 160, the pin 160*b* and the cap 170*c* are quite simple, and are less troubled.

Finally, the tandem regulating button mechanism 23 accelerates the escape in the silent mode without changing the key-touch.

Second Embodiment

Figure 9:
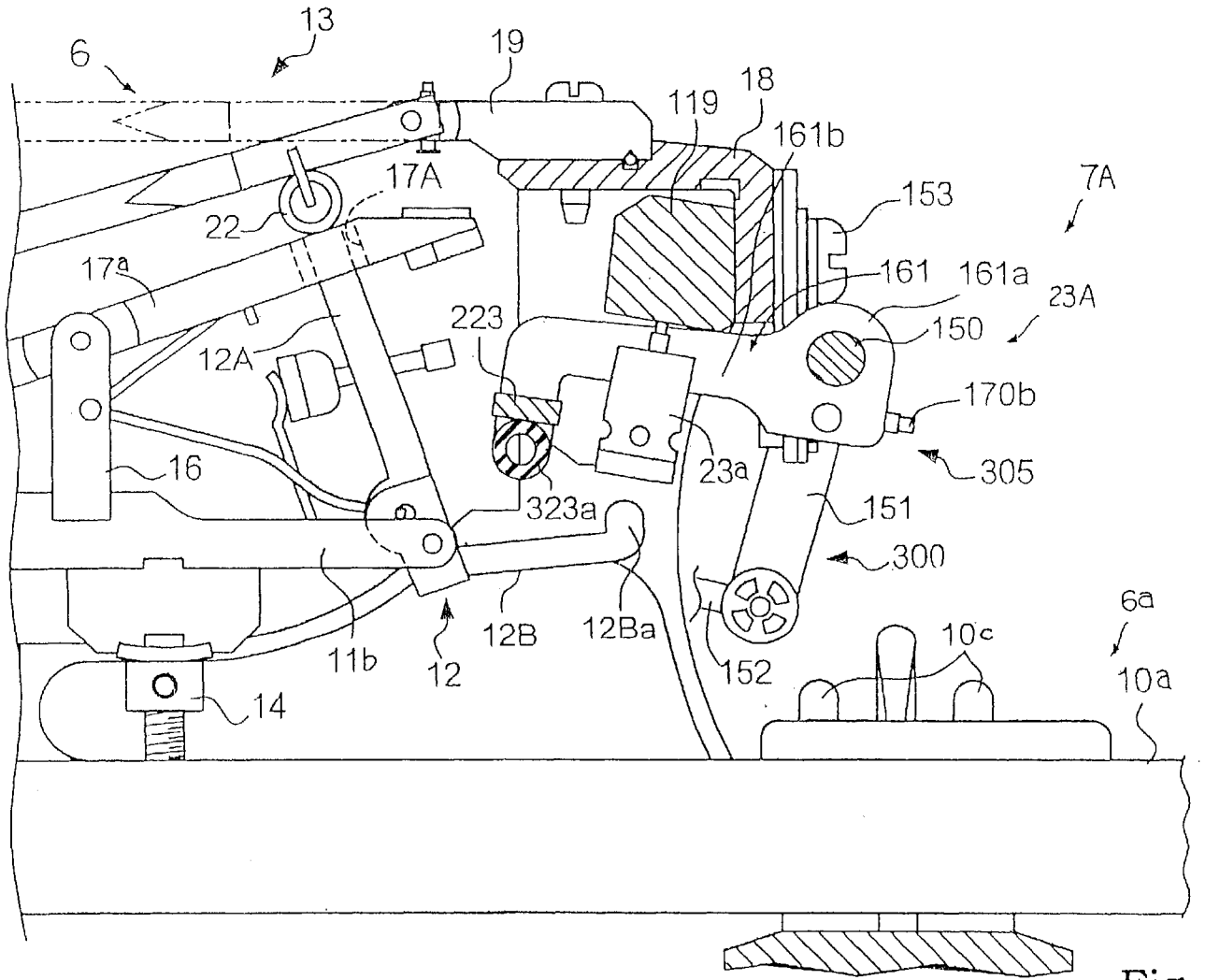
FIG. 9 is a side view showing the structure of another silent piano according to the present invention.

Turning to FIG. 9 of the drawings, another silent piano embodying the present invention also largely comprises a grand piano 6 and a silent system 7A. The grand piano is similar to the grand piano incorporated in the silent piano implementing the first embodiment, and the component parts are labeled with the references designating corresponding component parts of the grand piano of the first embodiment without detailed description.

The silent system 7A also includes the hammer stopper (not shown), electronic sound generating system (not shown) and an auxiliary regulating button sub-mechanism 23A. The auxiliary regulating button sub-mechanism 23A is similar to the auxiliary regulating button sub-mechanism incorporated in the first embodiment except damping means. The damping columns 223*a* are replaced with damping tubes 323*a*. The damping tubes 323*a* are resilient, and prohibit the jacks 12 from generating noise.

The jacks 12 are same as those of a standard grand piano, and only the hammer stopper, electronic sound generating system and the auxiliary regulating button sub-mechanism 23A are added to the grand piano in the retrofitting work. Thus, the silent piano and the silent system achieve all the advantages of those implementing the first embodiment.

Third Embodiment

Figure 10:
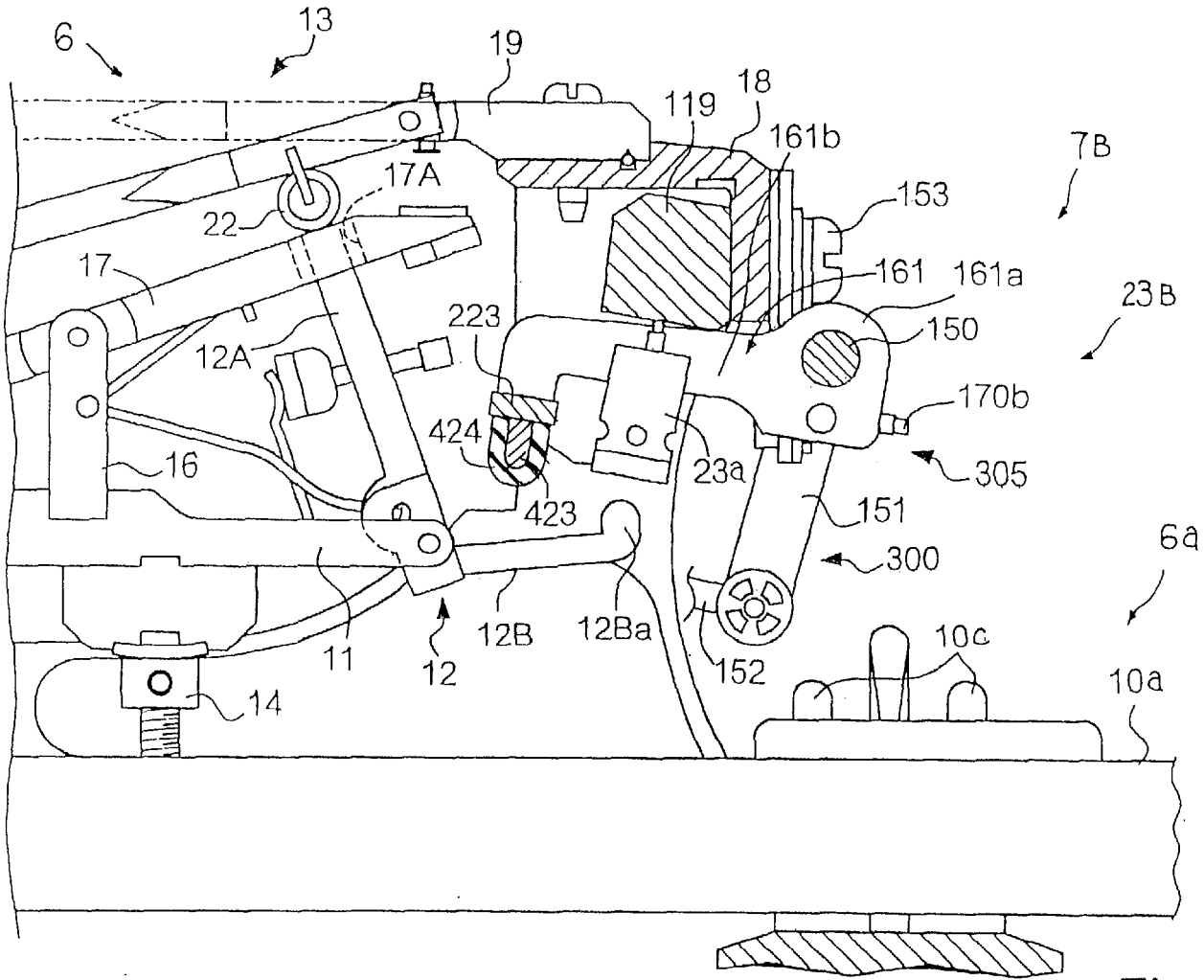
FIG. 10 is a side view showing the structure of yet another silent piano according to the present invention.

Turning to FIG. 10 of the drawings, yet another silent piano embodying the present invention also largely comprises a grand piano 6 and a silent system 7B. The grand piano is similar to the grand piano incorporated in the silent piano implementing the first embodiment, and the component parts are labeled with the references designating corresponding component parts of the grand piano of the first embodiment without detailed description.

The silent system 7B also includes the hammer stopper (not shown), electronic sound generating system (not shown) and an auxiliary regulating button sub-mechanism 23B. The auxiliary regulating sub-mechanism 23B is similar to the auxiliary regulating button sub-system except damping means. The damping columns 223*a* are replaced with composite dampers. Each of the composite dampers is implemented by a rigid strip 423 and a damping sheet 424. The rigid strip 423 downward projects from the lower surface of the regulating bar 223, and is covered with the damping sheet 424. The damping sheet 424 is, by way of example, formed of felt, cloth, sponge or cellular rubber, and, accordingly, is resilient. The damping sheets prohibit the jacks 12 from generating noise.

The jacks 12 are same as those of a standard grand piano, and only the hammer stopper, electronic sound generating system and the auxiliary regulating button sub-mechanism 23B are added to the grand piano in the retrofitting work. Thus, the silent piano and the silent system achieve all the advantages of those implementing the first embodiment.

Fourth Embodiment

Figure 11:
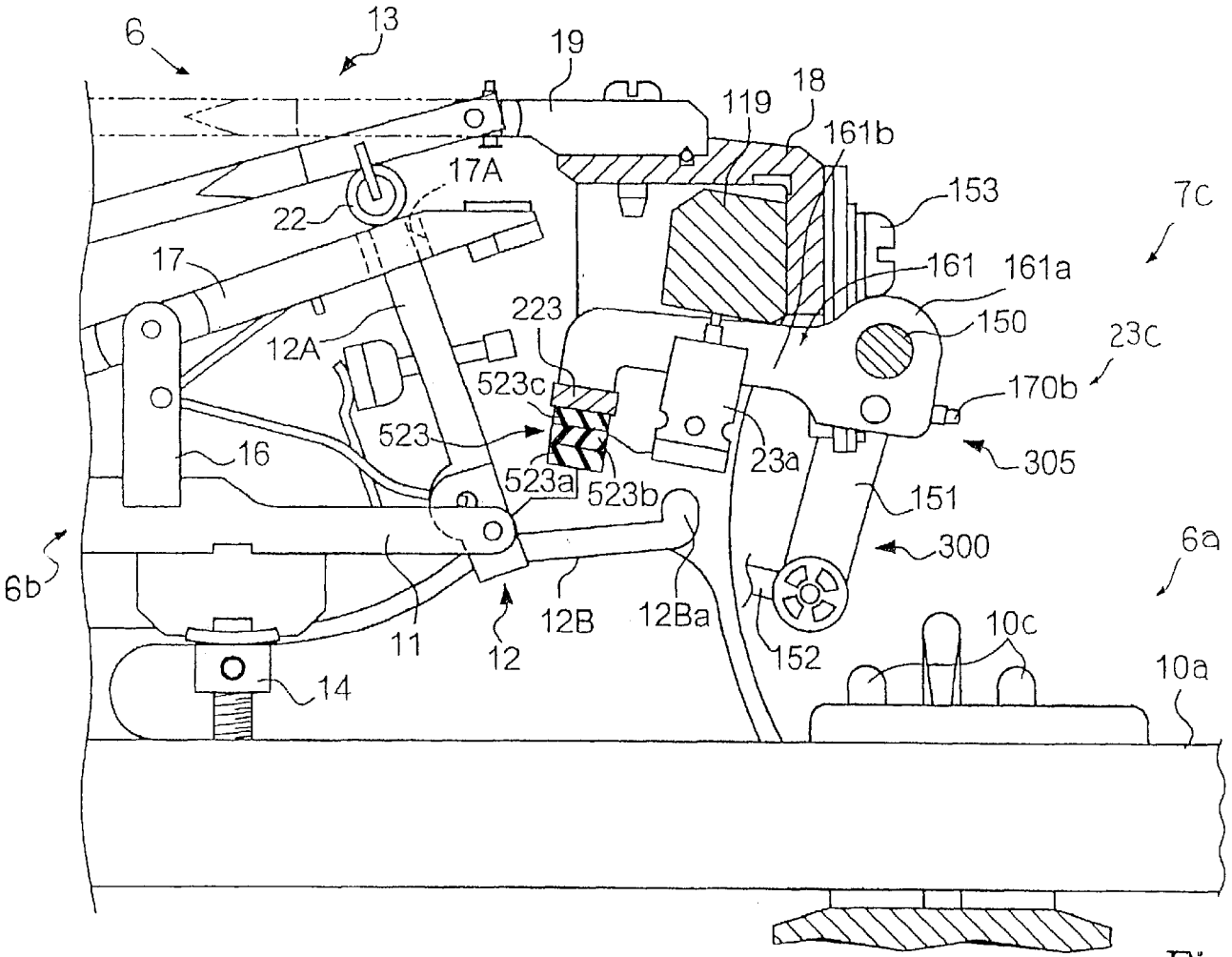
FIG. 11 is a side view showing the structure of still another silent piano according to the present invention.

Turning to FIG. 11 of the drawings, yet another silent piano embodying the present invention also largely comprises a grand piano 6 and a silent system 7C. The grand piano is similar to the grand piano incorporated in the silent piano implementing the first embodiment, and the component parts are labeled with the references designating corresponding component parts of the grand piano of the first embodiment without detailed description.

The silent system 7C also includes the hammer stopper (not shown), electronic sound generating system (not shown) and an auxiliary regulating button sub-mechanism 23C. The auxiliary regulating sub-mechanism 23C is similar to that incorporated in the first embodiment except damping means. The damping columns 223*a* are replaced with laminated dampers 523. Each of the laminated dampers 523 is implemented by plural resilient layers 523*a*/523*b*/523*c*. The resilient layers 523*a*/523*b*/523*c* are different in resiliency from one another. The resilient layer 523*a* is the softest of all, and is widely deformable. The resilient layer 523*b* is softer than the resilient layer 523*c*, and the resilient layer 523*c* is less deformed. In other words, the damping capacity is reduced from the resilient layer 523*a* to the resilient layer 523*c*. The laminated dampers 523 are desirable, because a tuner easily positions it at the appropriate position. The foot portion 12B is firstly brought into contact with the softest layer 523*a*. The softest layer 523*a* is so soft that the jack 12 is brought into contact with it without noise. The jack 12 deforms the next layer 523*b*, and finally reaches the relatively hard layer 523*c*. The layer 523*c* is less deformed, and surely causes the jack to turn about the end portion of the whippen assembly 11*b*. The manufacturer may design the laminated dampers 523 to achieve the key touch same as the key touch in the acoustic sound mode.

The jacks 12 are same as those of a standard grand piano, and only the hammer stopper, electronic sound generating system and the auxiliary regulating button sub-mechanism 23C are added to the grand piano in the retrofitting work. Thus, the silent piano and the silent system achieve all the advantages of those implementing the first embodiment.

Although particular embodiments of the present invention have been shown and described, it will be apparent to those skilled in the art that various changes and modifications may be made without departing from the spirit and scope of the present invention.

For example, only one bearing unit 154 or more than two bearing units may rotatably connect the shaft 150 to the shank flange rail 18. The damping columns or damping tubes may be replaced with damping semi-columns or damping half-tubes.

The auxiliary regulating button sub-mechanisms may be modified for a silent piano fabricated on the basis of an upright piano. When the upright piano is retrofitted to the silent piano, the user appreciates the auxiliary regulating button sub-mechanism, because it reduces the cost for retrofitting the upright piano to the silent piano.

An automatic player piano may be retrofitted to a silent piano. The automatic player piano is also a piano-based musical instrument. An automatic playing system is incorporated in an acoustic piano, i.e., the grand piano or upright piano. The automatic playing system selectively moves the black/white keys without human player for performing a piece of music. The silent system, which includes the auxiliary regulating button sub-mechanism according to the present invention, is installed in the automatic player piano so that the user enjoys a piece of music in various ways.

The tandem regulating button mechanism according to the present invention may form a part of another kind of keyboard musical instrument. The keyboard musical instrument is hereinbelow referred to as "Mute Piano". The mute piano is a piano-based keyboard musical instrument. Although the tandem regulating button mechanism according to the present invention is installed in the mute keyboard, the hammer stopper and the electronic sound generating system are not incorporated in the mute keyboard. The tandem regulating button mechanism is changed to the first angular position, the mute piano generates the usual piano tones. When the tandem regulating button mechanism is changed to the second angular position, the damping columns are moved into the trajectories of the foot portions. The foot portions are brought into contact with the damping columns concurrently with or earlier than the regulating buttons so that the jacks are rotated at larger angular velocity. The leg portions slide on the hammer rollers, and the force is insufficiently transmitted from the leg portions to the hammer rollers. Although the hammer assemblies start the free rotation, the hammer assemblies are slowly moved on the trajectories, and the hammer heads softly rebound on the strings. As a result, the vibrations are weak, and the loudness is reduced rather than that of the usual piano tones.

Another mute piano is equipped with the hammer stopper. The hammer stopper is changed between the free position and a mute position. When the hammer stopper is in the mute position, the hammer head and the hammer shank concurrently reach the strings and the impact absorber. For this reason, the strings are softly struck with the hammer head, and the loudness is reduced.

In the above-described embodiments, the damping members such as the damping columns 223*a* are secured to the lower surfaces of the regulating bars, and the change-over mechanism 300 moves the damping members into and out of the trajectories of the foot portions. However, the regulating bars may have an impact absorbing capability. In this instance, the change-over mechanism widely moves the regulating bars so as to cause the regulating bars to enter the trajectories of the foot portions and vacate therefrom.

What is claimed is:

1. A composite keyboard musical instrument comprising:

an acoustic piano including a keyboard having plural keys selectively moved by a player positioned in front of the keyboard, plural action units respectively connected to said keys so as to be selectively actuated by the keys moved by said player and having jacks rotatable about axes of rotation, respectively, and a primary regulating member for producing first escapes of said jacks when first portions of said jacks are brought into contact with said primary regulating member, plural beating members respectively driven for rotation by said plural action units when said first escapes or second escapes are produced, and plural vibratory members respectively struck with said plural beating members at the end of said rotation; and an auxiliary regulating button sub-mechanism including a secondary regulating member moved into the trajectories of said jacks and permitting second portions of said jacks closer to said axes of rotation than said first portions to be brought into contact therewith for said second escapes at certain timing not later than the contact between said first portions and said primary regulating member, and a change-over mechanism connected to said secondary regulating member so as to move said secondary regulating member into and out of said trajectories of said jacks.

2. The composite keyboard musical instrument as set forth in claim 1, in which said plural action units are provided over a rear portion of said keyboard so that a free space is created over a front portion of said keyboard, and said auxiliary regulating sub-mechanism further includes an adjuster exposed to said free space and manipulated for changing a distance between said secondary regulating member and said second portions of said jacks.

3. The composite keyboard musical instrument as set forth in claim 1, further comprising a stopper changed between a free position out of trajectories of said plural beating members and an interfering position on said trajectories of said plural beating members, and said plural beating members rebound on said stopper at certain timing not later than said plural beating members strike said plural vibratory members.

4. The composite keyboard musical instrument as set forth in claim 3, further comprising an electronic sound generating system for producing electronic tones instead of acoustic tones to be generated from said plural vibratory members.

5. The composite keyboard musical instrument as set forth in claim 1, in which said jacks have respective leg portions, respective foot portions respectively inclined from said leg portion at a certain angle and respective toes formed at leading ends of said foot portions, and said toes serving as said first portions and flat surfaces of said foot portions serving as said second portions are brought into contact with said primary regulating member and said secondary regulating member, respectively.

6. The composite keyboard musical instrument as set forth in claim 5, in which said second regulating member includes a regulating bar fixed to said change-over mechanism and a damper secured to said regulating bar and moved into and out of trajectories of said flat surfaces so that said jacks escape from said plural beating members without noise.

7. The composite keyboard musical instrument as set forth in claim 6, in which said regulating bars are divided into plural regulating sub-bars, and said damper is constituted by plural damper members respectively secured to said regulating sub-bars.

8. The composite keyboard musical instrument as set forth in claim 6, said damper has a rigid member secured to said regulating bar and a resilient member with which said rigid member is covered.

9. The composite keyboard musical instrument as set forth in claim 6, in which said damper includes plural layers laminated on said regulating bar, and damping capability is increased from the layer held in contact with said regulating bar to the layer with which said flat surfaces are brought into contact.

10. A silent system installed in an acoustic piano for retrofitting said acoustic piano to a composite keyboard musical instrument, comprising:

an auxiliary regulating button mechanism associated with an action mechanism of said acoustic piano, and including a regulating member movable into trajectories of jacks of said acoustic piano and permitting inner portions of said jacks closer to axes of rotation for said jacks than outer portions of said jack to be brought into contact therewith at certain timing not later than the contact between said outer portions and regulating buttons of said acoustic piano and a change-over mechanism connected to said regulating member so as to move said regulating member into and out of said trajectories of said jacks;

a hammer stopper associated with hammers of said acoustic piano, and changed between a free position out of trajectories of said hammers and an interference position on said trajectories of said hammers so as to cause said hammers to rebound thereon; and an electronic sound generating system associated with at least keys of said acoustic piano, and generating electronic tones corresponding to piano tones to be generated by depressing said keys.

11. The silent system as set forth in claim 10, in which said jacks have respective leg portions, respective foot portions respectively inclined from said leg portion at a certain angle and respective toes formed at leading ends of said foot portions, and said toes serving as said outer portions and flat surfaces of said foot portions serving as said inner portions are brought into contact with said regulating buttons and said regulating member, respectively.

12. The silent system as set forth in claim 11, in which said regulating member includes a regulating bar fixed to said change-over mechanism and a damper secured to said regulating bar and moved into and out of trajectories of said flat surfaces so that said jacks escape from said hammers without noise.

13. The silent system as set forth in claim 12, in which said regulating bars are divided into plural regulating sub-bars, and said damper is constituted by plural damper members respectively secured to said regulating sub-bars.

14. The silent system as set forth in claim 12, said damper has a rigid member secured to said regulating bar and a resilient member with which said rigid member is covered.

15. The silent system as set forth in claim 12, in which said damper includes plural layers laminated on said regulating bar, and damping capability is increased from the layer held in contact with said regulating bar to the layer with which said flat surfaces are brought into contact.

16. An auxiliary regulating button mechanism for accelerating escape of jacks forming a part of an action mechanism incorporated in an acoustic piano, comprising:

a regulating member causing said jacks to escape from hammers of said acoustic piano when certain portions of said jacks are brought into contact therewith, said certain portions being closer to axes of rotations for said jacks than portions of said jacks to be brought into contact with regulating buttons of said action mechanism; and a change-over mechanism connected to said regulating member, and changing said regulating member between a first position out of the trajectories of said certain portions and a second position where said certain portions are brought into contact with said regulating member at certain timing not later than a contact timing at which said portions are brought into contact with said regulating buttons.

17. The auxiliary regulating button mechanism as set forth in claim 16, in which said jacks have respective leg portions, respective foot portions respectively inclined from said leg portion at a certain angle and respective toes formed at leading ends of said foot portions, and said toes serving as said portions and flat surfaces of said foot portions serving as said certain portions are brought into contact with said regulating buttons and said regulating member, respectively.

18. The auxiliary regulating button mechanism as set forth in claim 17, in which said regulating member includes a regulating bar fixed to said changeover mechanism and a damper secured to said regulating bar and moved into and out of trajectories of said flat surfaces so that said jacks escape from said hammers without noise.

19. The auxiliary regulating button mechanism as set forth in claim 18, in which said regulating bars are divided into plural regulating sub-bars, and said damper is constituted by plural damper members respectively secured to said regulating sub-bars.

20. The auxiliary regulating button mechanism as set forth in claim 18, said damper has a rigid member secured to said regulating bar and a resilient member with which said rigid member is covered.

21. The auxiliary regulating button mechanism as set forth in claim 18, in which said damper includes plural layers laminated on said regulating bar, and damping capability is increased from the layer held in contact with said regulating bar to the layer with which said flat surfaces are brought into contact.

* * * * *